US007523689B2

(12) United States Patent
Lin

(10) Patent No.: US 7,523,689 B2
(45) Date of Patent: Apr. 28, 2009

(54) TOOL COMBINATION

(75) Inventor: Hsi Chang Lin, Taichung Hsien (TW)

(73) Assignee: Huai Bao Co., Ltd., Dali, Taichung Hsien (TW)

( * ) Notice: Subject to any disclaimer, the term of this patent is extended or adjusted under 35 U.S.C. 154(b) by 55 days.

(21) Appl. No.: 11/901,563

(22) Filed: Sep. 18, 2007

(65) Prior Publication Data

US 2009/0071299 A1 Mar. 19, 2009

(51) Int. Cl.
*B25B 23/16* (2006.01)

(52) U.S. Cl. ..... 81/177.85; 81/177.2; 81/177.4; 81/438

(58) Field of Classification Search ..... 81/177.85, 81/177.2, 177.4, 437–439, 490
See application file for complete search history.

(56) References Cited

U.S. PATENT DOCUMENTS 5,732,606 A * 3/1998 Chiang ..... 81/177.2
5,957,014 A 9/1999 Tseng et al. ..... 81/439
6,243,902 B1 6/2001 Huang ..... 7/165
6,431,034 B1 8/2002 Chen ..... 81/177.4
6,508,156 B1 * 1/2003 Wei ..... 81/490
7,287,449 B2 * 10/2007 Abel et al. ..... 81/177.2

* cited by examiner

*Primary Examiner*—D. S Meislin
(74) *Attorney, Agent, or Firm*—Charles E. Baxley

(57) ABSTRACT

A tool combination includes a handle member having a chamber for receiving a tool stem which has a non-circular engaging hole, a driving shank selectively engaged into the passage of the tool stem and engaged with the non-circular engaging hole of the tool stem for being rotated by the tool stem, the driving shank includes a non-circular engaging hole for engaging with a tool element, and a wrench driving tool includes a stud selectively attached to the tool stem for being rotated by the tool stem, and a retaining device may detachably retain either the driving shank or the wrench driving tool to the tool stem and for changeably operating as a screw driver and a driving wrench.

12 Claims, 9 Drawing Sheets

TOOL COMBINATION

BACKGROUND OF THE INVENTION

1. Field of the Invention

The present invention relates to a tool combination, and more particularly to a tool combination including a structure for changeably conducting or operating as a screw driver and a driving wrench and for allowing the tool combination to be effectively operated by the users.

2. Description of the Prior Art

Typical tool combinations comprise two sections each having a stud or tool holder provided therein for engaging with various tool bits and for allowing the various tool bits to be selectively driven by the different sections.

For example, U.S. Pat. No. 5,957,014 to Tseng et al. discloses one of the typical tool combinations comprising a base having a stud for engaging with a tool bit, and a handle having a bore for engaging with the stud, and a stem secured to the handle for engaging with the tool bit.

However, the two sections may only be used to engage with or to rotate or to drive the screw driver bits, but may not be used or worked as a wrench device.

U.S. Pat. No. 6,243,902 to Huang discloses another typical tool combination comprising a handle having a chamber formed therein and a number of retainers for receiving or for engaging with various tool bits or sockets, and a driving stem for selectively rotating or driving the tool members.

However, the tool combination also may not be used or worked as a wrench device.

U.S. Pat. No. 6,431,034 to Chen discloses a further typical tool combination comprising a base handle member having a chamber formed therein and a number of retainers for receiving or for engaging with various tool bits or sockets or tool extensions, and a driving stem or tool extension and a wrench tool member selectively or changeably attached to the base handle member for being selectively rotated or driven by the base handle member.

However, the driving stem or tool extension should be removed or disengaged from the base handle member before the wrench tool member may be selectively or changeably attached to the base handle member such that the tool combination may not be easily operated by the users.

The present invention has arisen to mitigate and/or obviate the afore-described disadvantages of the conventional tools.

SUMMARY OF THE INVENTION

The primary objective of the present invention is to provide a tool combination including a structure for changeably conducting or operating as a screw driver and a driving wrench and for allowing the tool combination to be effectively operated by the users.

In accordance with one aspect of the invention, there is provided a tool combination comprising a handle member including a chamber formed therein, a tool stem including an inner end engaged into the chamber of the handle member and secured to the handle member, and including a passage formed therein, and including a non-circular engaging hole formed in an other end portion thereof and communicating with the passage thereof, a driving shank selectively engaged into the passage of the tool stem and engaged with the non-circular engaging hole of the tool stem for being rotated by the tool stem, the driving shank including a non-circular engaging hole formed in an outer portion thereof for selectively engaging with a tool element, a biasing device for biasing the driving shank out of the tool stem, and for allowing the driving shank to be selectively engaged into the passage of the tool stem, a wrench driving tool including a stud selectively engaged into the non-circular engaging hole of the tool stem for being selectively rotated by the tool stem, and a retaining device for detachably and selectively retaining either the driving shank or the wrench driving tool to the tool stem.

The driving shank includes a magnetic attracting member disposed in the engaging hole of the driving shank for attracting and retaining the tool element to the driving shank. The biasing device includes a spring member disposed in the passage of the tool stem and engage with the driving shank for biasing and forcing the driving shank to extend out of the tool stem.

The tool stem includes an end cap attached to the inner end of the tool stem and engage with the spring member. The driving shank includes a cavity formed in an inner end portion thereof for partially receiving the spring member.

The driving shank and the stud of the wrench driving tool each include a peripheral groove formed in an outer peripheral portion thereof, and the detachably retaining device includes a detent selectively engageable with the peripheral groove of the driving shank and the stud of the wrench driving tool.

The detachably retaining device includes a sleeve slidably engaged onto the tool stem and engageable with the detent for selectively actuating the detent to engage with either the driving shank or the wrench driving tool.

The sleeve includes an actuator for selectively engaging with the detent and for selectively actuating the detent to engage with either the driving shank or the wrench driving tool, and includes a depression formed therein for selectively receiving the detent and for allowing the detent to be selectively disengaged from the driving shank or the wrench driving tool.

The detachably retaining device includes a spring member engaged with the sleeve for biasing the actuator of the sleeve to engage with the detent. The tool stem includes a retaining ring disposed thereon for selectively engaging with the sleeve and for limiting the sleeve to move relative to the tool stem and for preventing the sleeve from being disengaged from the tool stem.

The driving shank includes at least one fin extended radially and outwardly therefrom for engaging with the tool stem and for centering the driving shank to the tool stem. The handle member includes a cover member detachably engaged with the handle member, the cover member includes a number of cavities for receiving tool elements, and a socket member having a non-circular engaging hole for selectively engaging with the tool elements.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
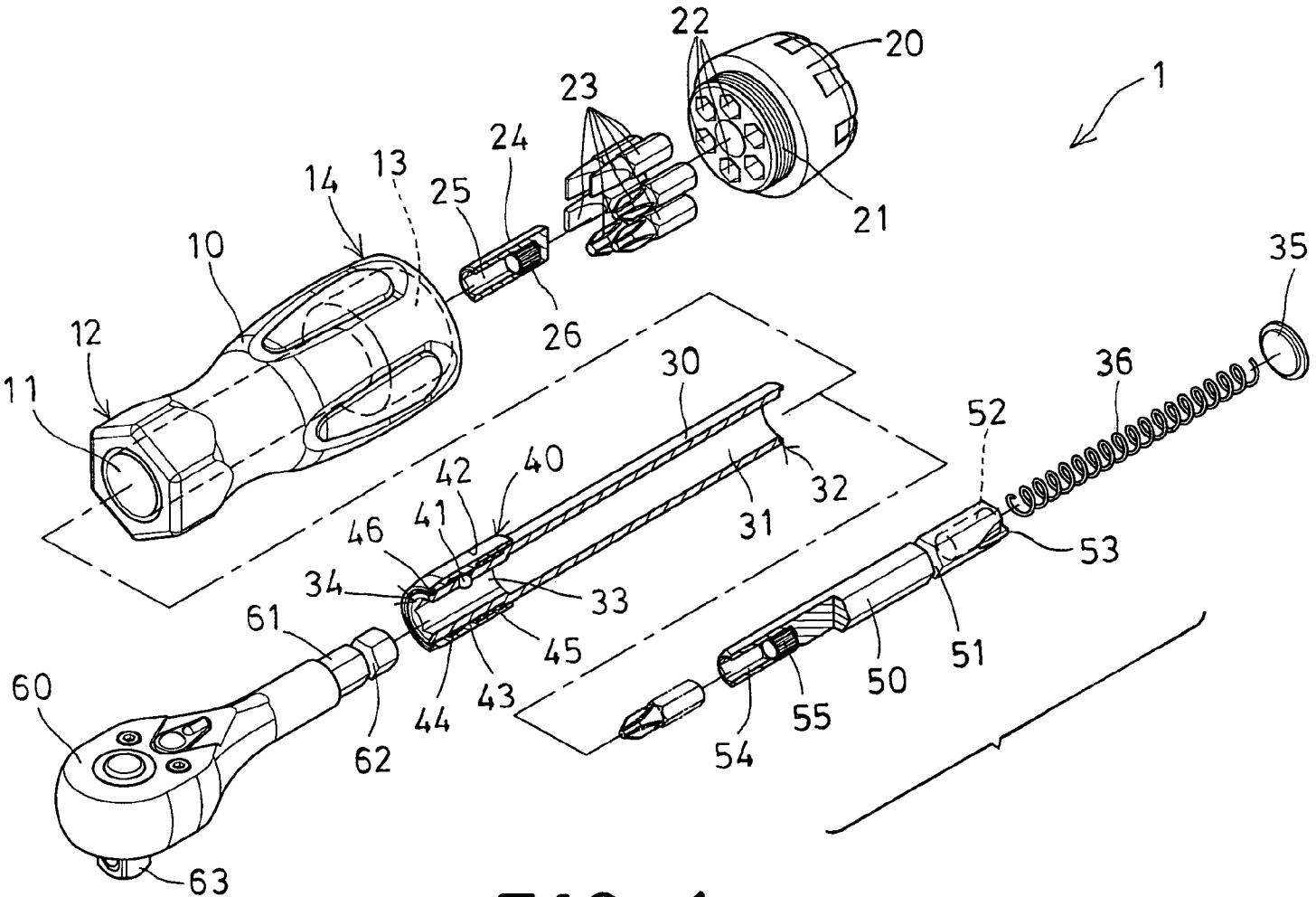
FIG. 1 is a partial exploded view of a tool combination in accordance with the present invention.
Figure 2:
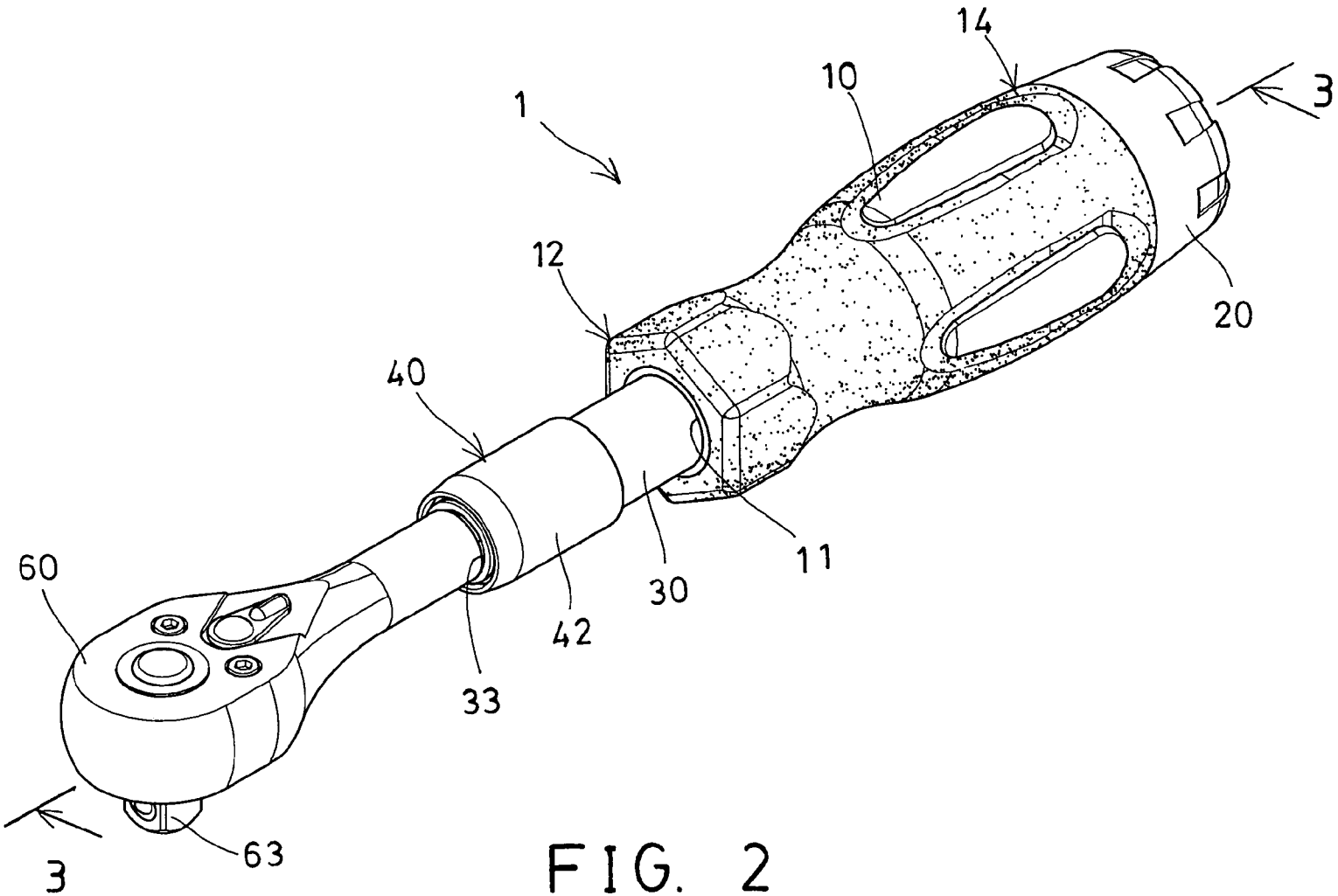
FIG. 2 is a perspective view of the tool combination which is worked as a wrench device.

Referring to the drawings, and initially to FIGS. 1-4, a tool combination 1 in accordance with the present invention comprises a base handle member 10 including a blind hole or chamber 11 formed in one end or front end portion 12 thereof, and including a compartment 13 formed in the other end or rear end portion 14 thereof, and including an inner thread 15 formed in the compartment 13 or the rear end portion 14 of the handle member 10 for threading or engaging with a cover member 20 which includes an outer thread 21 formed on the outer portion thereof for engaging with the inner thread 15 of the handle member 10 and for detachably removed or disengaged from the handle member 10.

The cover member 20 includes a number of cavities 22 formed therein for detachably receiving or engaging with various tool elements or tool bits 23, and includes a socket member 24 disposed or attached or secured in the middle or center portion of the cover member 20, and includes a non-circular engaging hole 25 formed in the socket member 24 for selectively engaging with the tool elements or tool bits 23, and for allowing the tool elements or tool bits 23 to be selectively rotated or driven by the cover member 20. The cover member 20 may further include a magnet or magnetic attracting member 26 disposed or secured in the engaging hole 25 of the socket member 24 for attracting or retaining the tool elements or tool bits 23 to the socket member 24.

A tool stem 30 includes a passage 31 formed therein, and includes one end or inner end 32 engaged into the chamber 11 of the handle member 10 and attached or secured to the handle member 10 with such as keys or latches or catches or fasteners (not shown) or by welding processes, and includes a non-circular engaging hole 33 formed in the other end portion 34 thereof and communicating with the passage 31 thereof for selectively engaging with a driving shank 50 (FIGS. 1, 3-5), a stud 61 of a driving tool 60 (FIGS. 1-4), such as a driving wrench device 60, a stud 64 of a chisel 63 (FIG. 6), a stud 66 of a saw device 65 (FIG. 6), or the like, and includes a retaining means or device 40 disposed or attached or engaged onto the other end portion 34 of the tool stem 30. The driving shank 50 and the studs 61, 64, 66 of the driving tool 60 or the chisel 63 or the saw device 65 include a non-circular cross section for engaging with the non-circular engaging hole 33 of the tool stem 30 and for allowing the driving shank 50 or the driving tool 60 or the chisel 63 or the saw device 65 to be rotated or driven by the tool stem 30.

Figure 4:
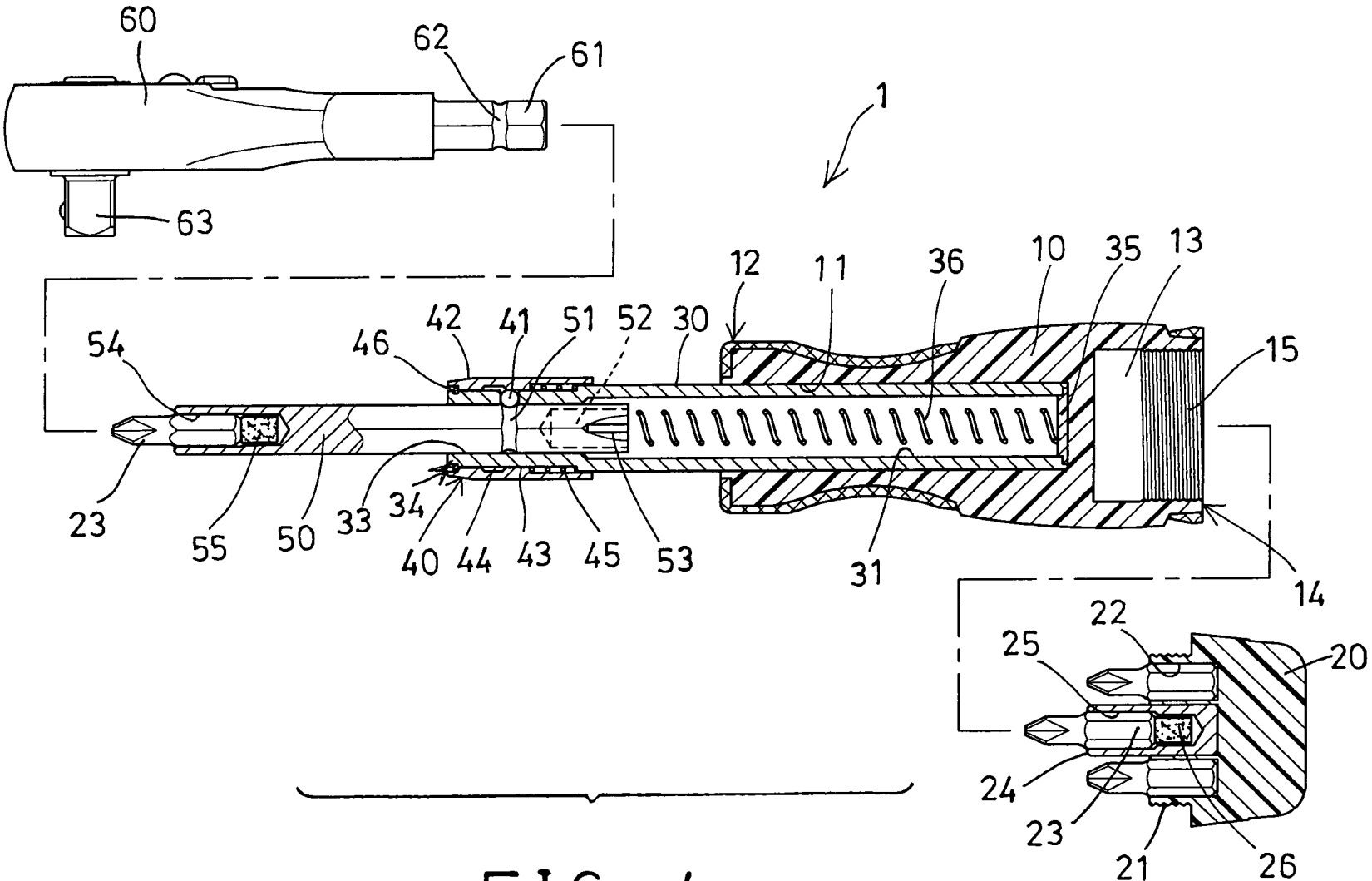
FIG. 4 is a partial exploded and partial cross sectional view of the tool combination.

The retaining means or device 40 includes a ball or detent 41 slidably disposed or engaged in the other end portion 34 of the tool stem 30 and engageable into the engaging hole 33 of the tool stem 30 for selectively engaging with the driving shank 50 or the studs 61, 64, 66 of the driving tool 60 or the chisel 63 or the saw device 65 and for detachably retaining or securing the driving shank 50 or the studs 61, 64, 66 of the driving tool 60 or the chisel 63 or the saw device 65 to the tool stem 30, and includes a control ferrule or sleeve 42 slidably engaged onto the other end portion 34 of the tool stem 30 and engageable with the detent 41 for selectively actuating or forcing the detent 41 to engage with the driving shank 50 or the studs 61, 64, 66 of the driving tool 60 or the chisel 63 or the saw device 65 (FIG. 4).

For example, the sleeve 42 includes a bulge or actuator 43 for selectively engaging with the detent 41 and for selectively actuating or forcing the detent 41 to engage with the driving shank 50 or the studs 61, 64, 66 of the driving tool 60 or the chisel 63 or the saw device 65, and includes a depression 44 formed therein for selectively receiving the detent 41 and for allowing the detent 41 to be selectively disengaged from the driving shank 50 or the studs 61, 64, 66 of the driving tool 60 or the chisel 63 or the saw device 65, and includes a spring member 45 engaged between the tool stem 30 and the sleeve 42 for biasing or forcing the actuator 43 to engage with the detent 41 and thus for actuating or forcing the detent 41 to engage with the driving shank 50 or the studs 61, 64, 66 of the driving tool 60 or the chisel 63 or the saw device 65.

Figure 3:
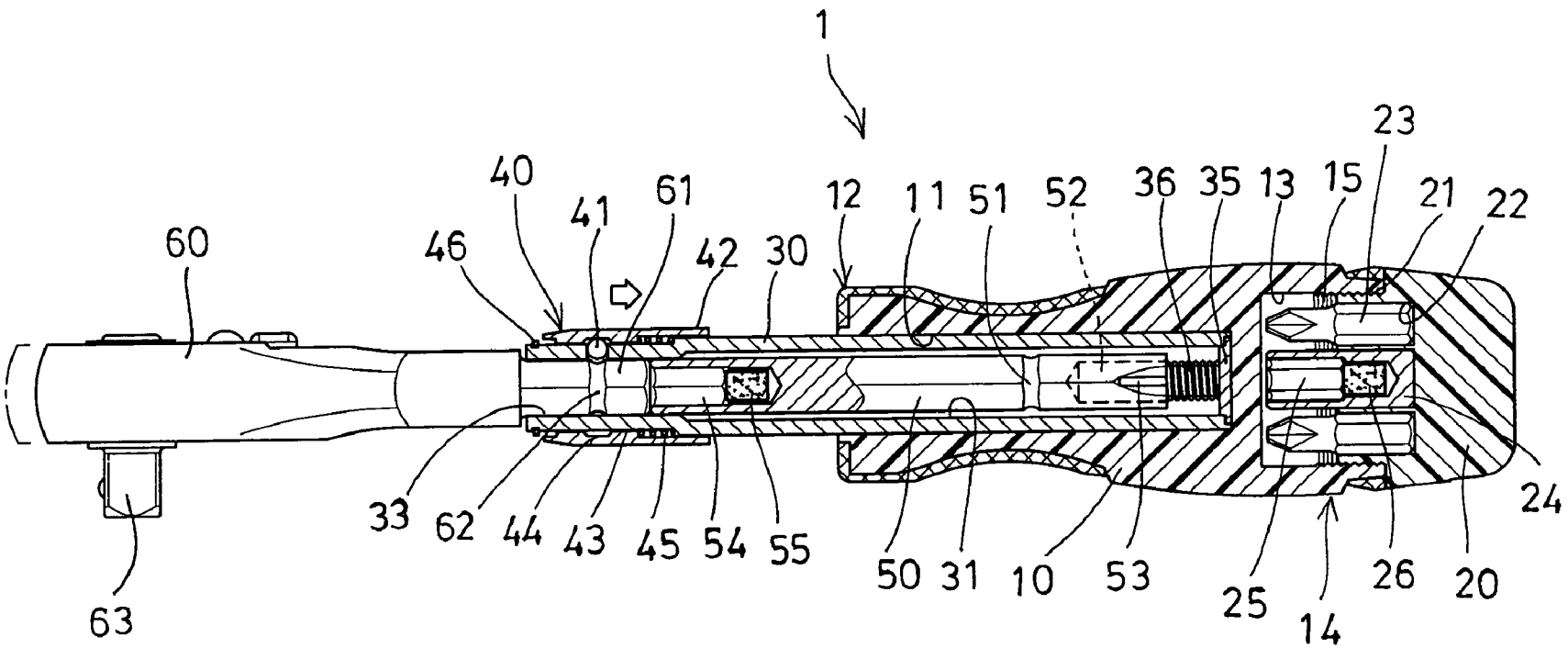
FIG. 3 is a partial cross sectional view of the tool combination taken along lines 3-3 of FIG. 2.

The tool stem 30 or the retaining means or device 40 may include a retaining ring 46 disposed or attached onto the other end portion 34 of the tool stem 30 for selectively engaging with the sleeve 42 and for limiting the sleeve 42 to move relative to the tool stem 30, and for preventing the sleeve 42 and the spring member 45 from being disengaged from the tool stem 30. The tool stem 30 may include an end cap 35 disposed or attached in the inner end 32 of the tool stem 30, and another spring biasing means or member 36 disposed or engaged in the passage 31 of the tool stem 30 and engageable with the driving shank 50 for selectively biasing or forcing the driving shank 50 to partially extend out of the other end portion 34 of the tool stem 30 or for allowing the driving shank 50 to be forced and moved or engaged into the passage 31 of the tool stem 30 (FIG. 3).

The driving shank 50 and the studs 61, 64, 66 of the driving tool 60 or the chisel 63 or the saw device 65 each include a peripheral groove 51, 62 formed in the outer peripheral portion thereof for selectively engaging with the detent 41 (FIGS. 3, 4) and for stably or solidly retaining or anchoring the driving shank 50 and the tool device 60, 63, 65 to the tool stem 30. It is preferable that the driving shank 50 includes a cavity 52 formed in the inner end portion thereof for partially receiving the spring member 36 and for allowing the spring member 36 to be stably or solidly retained or anchored between the driving shank 50 and the end cap 35 of the tool stem 30, and includes one or more fins 53 extended radially and outwardly therefrom for engaging with the tool stem 30 and for centering the driving shank 50 to the tool stem 30.

The driving shank 50 includes a non-circular engaging hole 54 formed in the outer portion thereof for selectively engaging with the tool elements or tool bits 23, and for allowing the tool elements or tool bits 23 to be selectively rotated or driven by the driving shank 50. The driving shank 50 may further include a magnet or magnetic attracting member 55 disposed or secured in the engaging hole 54 of the driving shank 50 for attracting or retaining the tool elements or tool bits 23 to the driving shank 50. The driving wrench device 60 may further include a driving element 63 for acting or operating as a driving wrench device.

Figure 5:
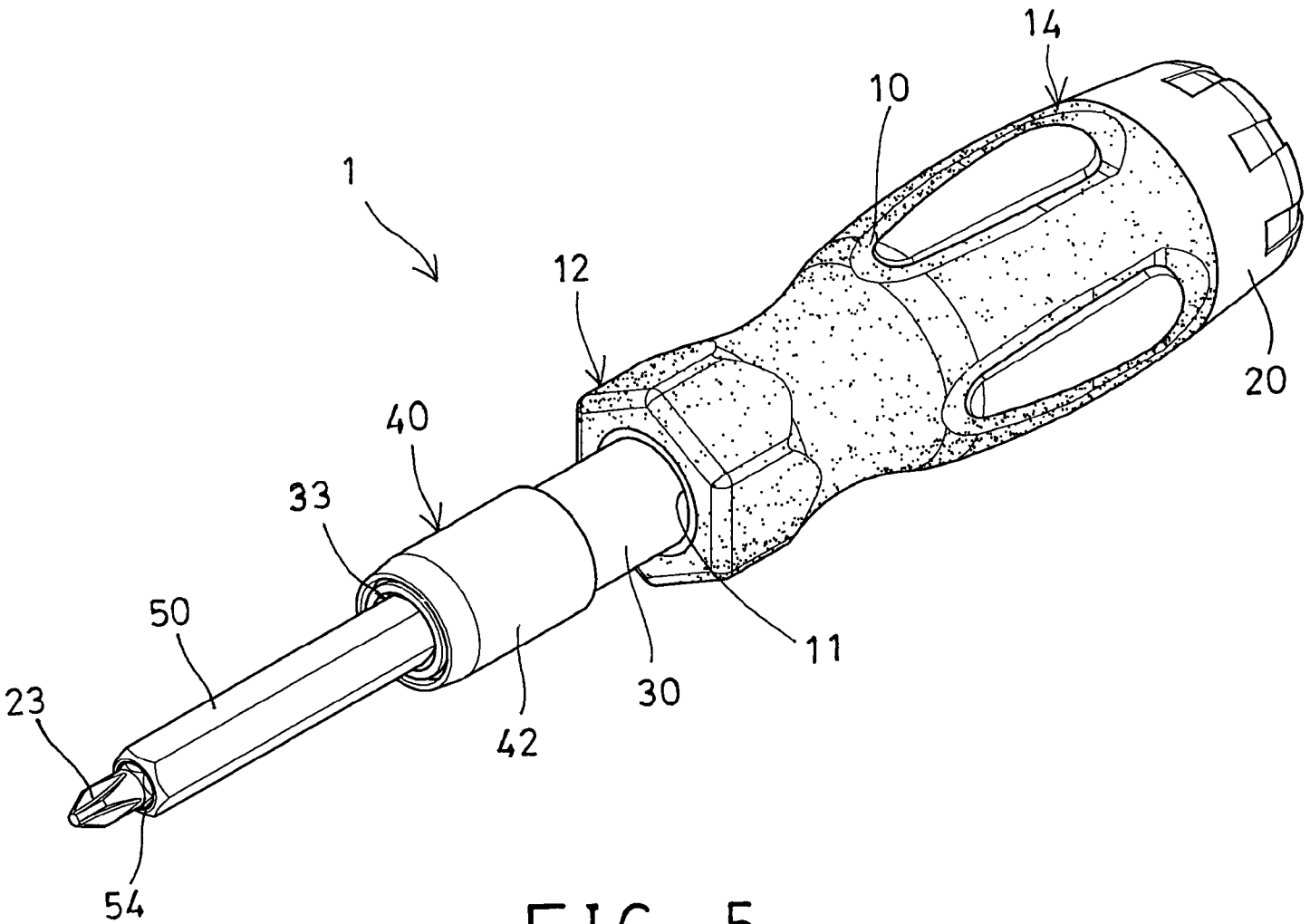
FIG. 5 is a perspective view of the tool combination which is worked as a screw driver device.
Figure 6:
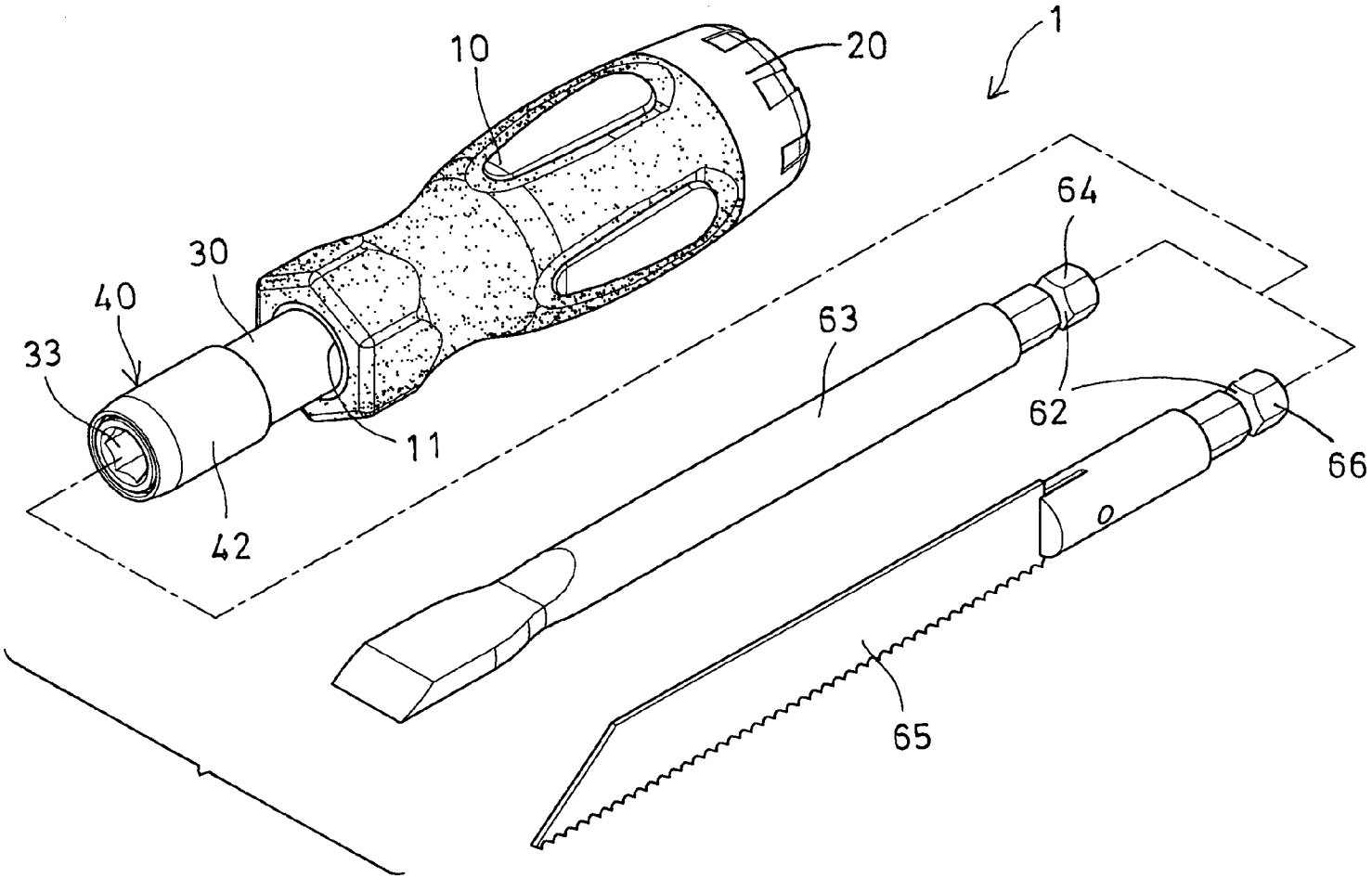
FIG. 6 is a partial exploded view illustrating the other tool members for selectively or changeably attaching to the base handle member.
Figure 7:
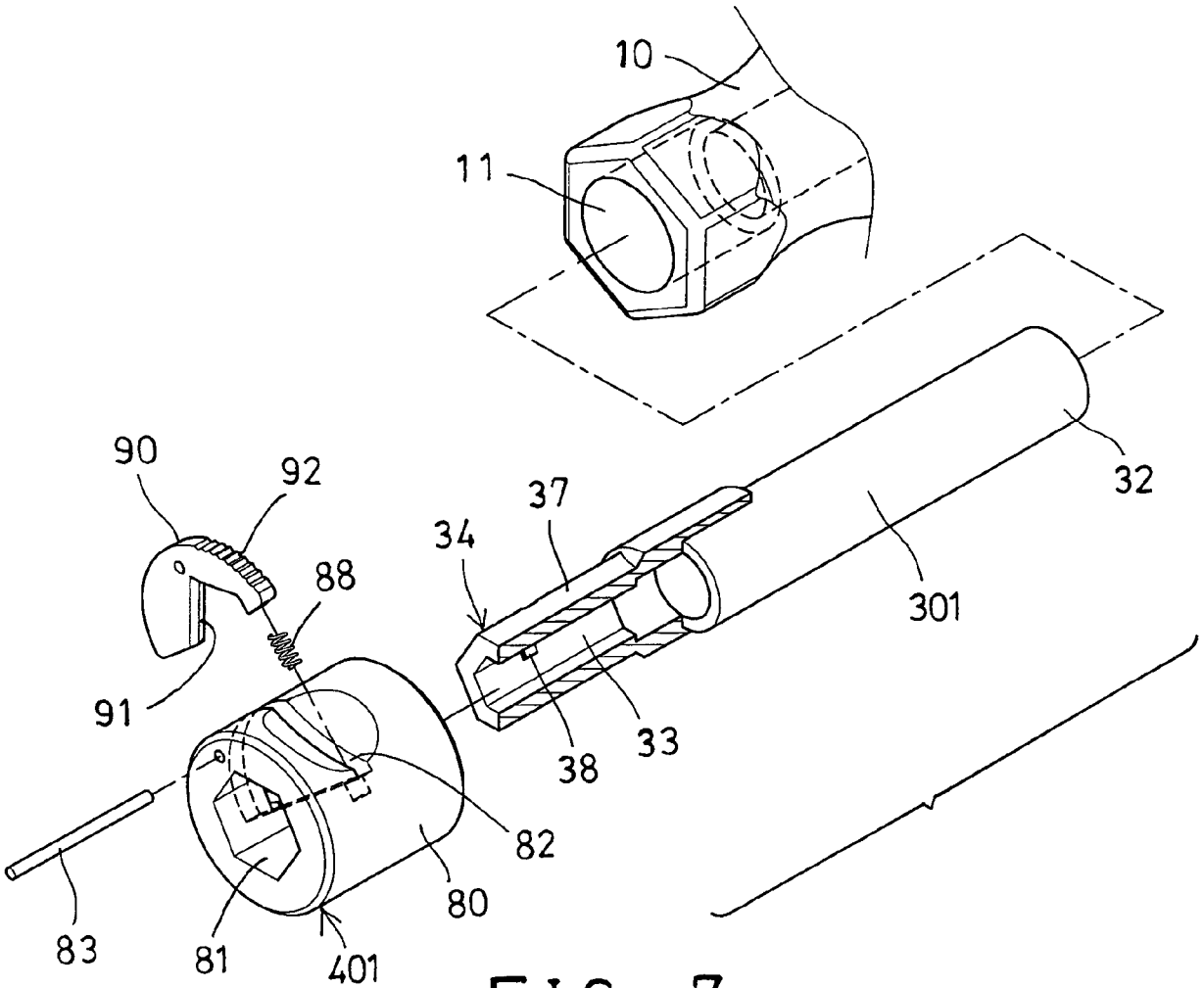
FIG. 7 is another partial exploded view illustrating the other arrangement of the tool combination.
Figure 8:
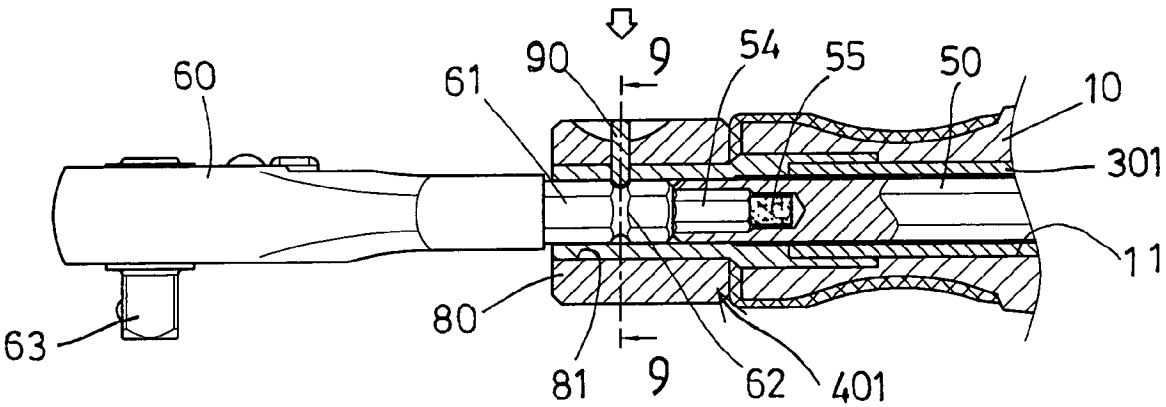
FIG. 8 is a partial cross sectional view of the tool combination as shown in FIG. 7.
Figure 9:
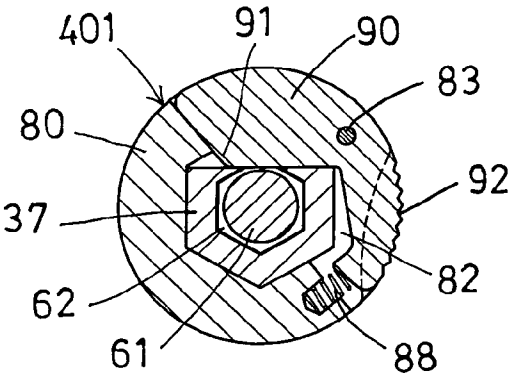
FIG. 9 is a cross sectional view of the tool combination taken along lines 9-9 of FIG. 8.
Figure 10:
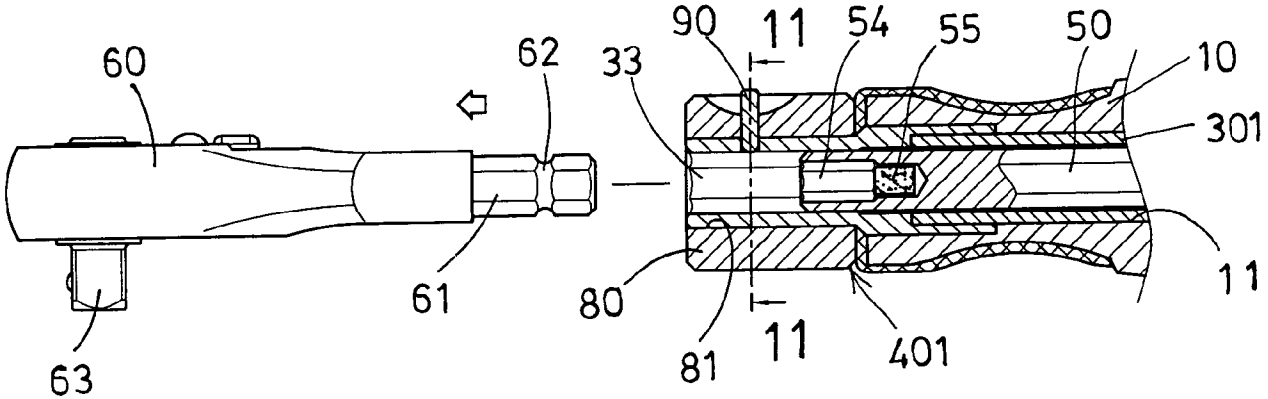
FIG. 10 is a further partial exploded and partial cross sectional view of the tool combination.
Figure 11:
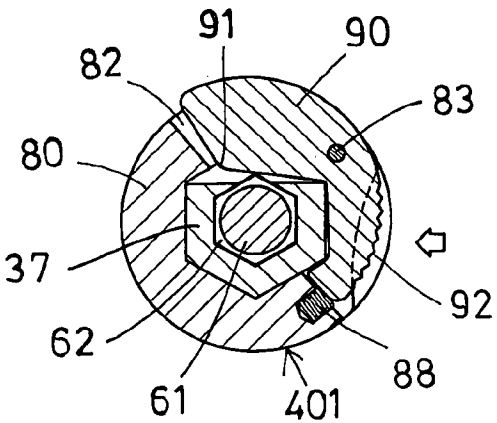
FIG. 11 is a cross sectional view of the tool combination taken along lines 11-11 of FIG. 10.

In operation, as shown in FIGS. 4 and 5, the driving shank 50 may be partially extended out of the tool stem 30 for selectively engaging with the tool elements or tool bits 23, and for selectively rotating or driving the tool elements or tool bits 23, and may be selectively disengaged from the tool stem 30 when the detent 41 is selectively received or engaged in the depression 44 of the sleeve 42 (FIG. 3), and the studs 61, 64, 66 of the driving tool 60 or the chisel 63 or the saw device 65 may then be selectively or changeably engaged into the engaging hole 33 of the tool stem 30 for being selectively rotated or driven by the tool stem 30. Alternatively, as shown in FIG. 3, the driving shank 50 may also be selectively engaged into the tool stem 30 when either of the studs 61, 64, 66 of the driving tool 60 or the chisel 63 or the saw device 65 is selectively or changeably engaged into the engaging hole 33 of the tool stem 30.

Further alternatively, as shown in FIGS. 7-11, the tool stem 301 may also include one end or inner end 32 engaged into the chamber 11 of the handle member 10 and attached or secured to the handle member 10, and includes a non-circular engaging hole 33 formed in the other end portion 34 thereof for selectively engaging with a driving shank, a stud 61 of a driving tool 60 such as a driving wrench device 60, or the like, and includes a non-circular outer peripheral portion 37, and includes a slot 38 formed therein and intersecting or communicating with the non-circular engaging hole 33 thereof for selectively aligning with the outer peripheral groove 62 of the driving tool 60.

The retaining means or device 401 includes a sleeve or barrel 80 having a non-circular engaging hole 81 formed therein for engaging with the non-circular outer peripheral portion 37 of the tool stem 301 and for anchoring the barrel 80 to the tool stem 301, the barrel 80 includes a channel 82 laterally formed therein and intersecting or communicating with the non-circular engaging hole 81 thereof for rotatably or pivotally receiving a pawl 90, and an axle 83 engaged into the barrel 80 and engaged through the pawl 90 for pivotally securing the pawl 90 to the barrel 80, and the pawl 90 includes a catch 91 engageable into the slot 38 and the engaging hole 33 of the tool stem 301 for selectively engaging with the outer peripheral groove 62 of the driving tool 60 (FIGS. 8, 9, 11) and for detachably retaining or securing the driving tool 60 to the tool stem 301.

The retaining means or device 401 includes a spring member 88 disposed or engaged with or between the barrel 80 and the pawl 90 for biasing or forcing the catch 91 of the pawl 90 to selectively engage with the outer peripheral groove 62 of the driving tool 60 and thus for detachably retaining or securing the driving tool 60 to the tool stem 301, the pawl 90 includes a hand grip 92 for being depressed by the users against the spring member 88 and for detachably disengaging the catch 91 of the pawl 90 from the driving tool 60, such that the catch 91 of the pawl 90 may also be used to detachably or changeably retain or anchor the tool device 60 to the tool stem 301.

Accordingly, the tool combination in accordance with the present invention includes a structure for changeably conducting or operating as a screw driver and a driving wrench and for allowing the tool combination to be effectively operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool combination comprising:

a handle member including a chamber formed therein, a tool stem including an inner end engaged into said chamber of said handle member and secured to said handle member, and including a passage formed therein, and including a non-circular engaging hole formed in an other end portion thereof and communicating with said passage thereof, a driving shank selectively engaged into said passage of said tool stem and engaged with said non-circular engaging hole of said tool stem for being rotated by said tool stem, said driving shank including a non-circular engaging hole formed in an outer portion thereof for selectively engaging with a tool element, means for biasing said driving shank out of said tool stem, and for allowing said driving shank to be selectively engaged into said passage of said tool stem, a wrench driving tool including a stud selectively engaged into said non-circular engaging hole of said tool stem for being selectively rotated by said tool stem, and means for detachably and selectively retaining either said driving shank or said wrench driving tool to said tool stem.

2. The tool combination as claimed in claim 1, wherein said driving shank includes a magnetic attracting member disposed in said engaging hole of said driving shank for attracting and retaining said tool element to said driving shank.

3. The tool combination as claimed in claim 1, wherein said biasing means includes a spring member disposed in said passage of said tool stem and engage with said driving shank for biasing and forcing said driving shank to extend out of said tool stem.

4. The tool combination as claimed in claim 3, wherein said tool stem includes an end cap attached to said inner end of said tool stem and engage with said spring member.

5. The tool combination as claimed in claim 3, wherein said driving shank includes a cavity formed in an inner end portion thereof for partially receiving said spring member.

6. The tool combination as claimed in claim 1, wherein said driving shank and said stud of said wrench driving tool each include a peripheral groove formed in an outer peripheral portion thereof, and said detachably retaining means includes a detent selectively engageable with said peripheral groove of said driving shank and said stud of said wrench driving tool.

7. The tool combination as claimed in claim 6, wherein said detachably retaining means includes a sleeve slidably engaged onto said tool stem and engageable with said detent for selectively actuating said detent to engage with either said driving shank or said wrench driving tool.

8. The tool combination as claimed in claim 7, wherein said sleeve includes an actuator for selectively engaging with said detent and for selectively actuating said detent to engage with either said driving shank or said wrench driving tool, and includes a depression formed therein for selectively receiving said detent and for allowing said detent to be selectively disengaged from said driving shank or said wrench driving tool.

9. The tool combination as claimed in claim 8, wherein said detachably retaining means includes a spring member engaged with said sleeve for biasing said actuator of said sleeve to engage with said detent.

10. The tool combination as claimed in claim 7, wherein said tool stem includes a retaining ring disposed thereon for selectively engaging with said sleeve and for limiting said sleeve to move relative to said tool stem and for preventing said sleeve from being disengaged from said tool stem.

11. The tool combination as claimed in claim 1, wherein said driving shank includes at least one fin extended radially and outwardly therefrom for engaging with said tool stem and for centering said driving shank to said tool stem.

12. The tool combination as claimed in claim 1, wherein said handle member includes a cover member detachably engaged with said handle member, said cover member includes a plurality of cavities formed therein for receiving tool elements, and includes a socket member having a non-circular engaging hole for selectively engaging with the tool elements.

* * * * *